US008006327B1

(12) United States Patent
Burchett

(10) Patent No.: US 8,006,327 B1
(45) Date of Patent: Aug. 30, 2011

(54) PIVOTING LEG ASSEMBLY FOR FOLDING FURNITURE

(75) Inventor: Dale D. Burchett, Louisville, KY (US)

(73) Assignee: C.A.B., Inc., Louisville, KY (US)

( * ) Notice: Subject to any disclaimer, the term of this patent is extended or adjusted under 35 U.S.C. 154(b) by 114 days.

(21) Appl. No.: 12/365,449

(22) Filed: Feb. 4, 2009

Related U.S. Application Data

(60) Provisional application No. 61/027,213, filed on Feb. 8, 2008.

(51) Int. Cl.
*A47C 17/38* (2006.01)

(52) U.S. Cl. ..... 5/136; 5/133; 5/159.1; 5/310; 5/311; 5/312; 5/315.2

(58) Field of Classification Search ..... 5/131, 133, 5/136, 137, 139, 146, 147, 310, 311, 312, 5/313.1, 314.1, 315.1, 315.2, 316, 29, 38, 5/145, 155, 159.1; 108/35, 38, 40, 41, 42, 108/48

See application file for complete search history.

(56) References Cited

U.S. PATENT DOCUMENTS

| | | | | | |
|---|---|---|---|---|---|
| 98,858 | A | * | 1/1870 | Farson | 5/38 |
| 411,641 | A | | 9/1889 | Brown | |
| 1,265,257 | A | | 5/1918 | Schellinger | |
| 2,663,029 | A | * | 12/1953 | Whitley et al. | 5/634 |
| 2,750,602 | A | | 6/1956 | Blanke | |
| 3,179,956 | A | | 4/1965 | Bennett | |
| 3,295,149 | A | | 1/1967 | Hall | |
| 3,628,199 | A | | 12/1971 | Helton | |
| 3,857,343 | A | * | 12/1974 | Greenberg | 108/133 |
| 4,103,373 | A | | 8/1978 | Luedtke et al. | |
| 4,736,476 | A | | 4/1988 | Maqueira | |
| 4,803,930 | A | * | 2/1989 | Crocoli | 108/48 |
| 4,901,382 | A | | 2/1990 | Spitz | |
| 5,033,134 | A | | 7/1991 | Burchett | |
| 5,978,988 | A | | 11/1999 | Burchett | |
| 6,105,185 | A | * | 8/2000 | DiRocco | 5/164.1 |
| 6,439,133 | B1 | * | 8/2002 | Jaramillo | 108/25 |
| 2008/0052824 | A1 | | 3/2008 | Stoltzfus | |

FOREIGN PATENT DOCUMENTS

| | | |
|---|---|---|
| FR | 2602655 | 2/1988 |
| GB | 2112278 | 7/1983 |
| WO | 2004023940 | 3/2004 |

OTHER PUBLICATIONS

Hafele North America Co., Foldaway Bed Leg, page from online catalog available at http://www.hafele.com/us/.

* cited by examiner

*Primary Examiner* — Robert G Santos
*Assistant Examiner* — Nicholas Polito
(74) *Attorney, Agent, or Firm* — Stites & Harbison, PLLC; David W. Nagle, Jr.

(57) ABSTRACT

A pivoting leg assembly for an article of folding furniture having a frame and which can be rotated between a storage position and a use position includes: a leg support bar adapted for slidable movement with respect to the frame, such that the leg support bar can move forward and rearward in a plane substantially parallel to the frame; and a leg pivotally connected to the leg support bar, such that it can be pivoted from a first position to a second position in which it extends downward and away from the frame, thus providing support to the frame in the use position.

13 Claims, 5 Drawing Sheets

PIVOTING LEG ASSEMBLY FOR FOLDING FURNITURE

CROSS-REFERENCE TO RELATED APPLICATIONS

The present application claims priority to U.S. Provisional Patent Application Ser. No. 61/027,213 filed on Feb. 8, 2008, the entire disclosure of which is incorporated herein by reference.

BACKGROUND OF THE INVENTION

The present invention relates to folding furniture and, more specifically, to a pivoting leg assembly for an article of folding furniture that is rotated between a substantially upright storage position and a substantially horizontal use position.

Various forms of folding furniture are well known in the prior art and are commonly used where available space within the area of use is limited. Such folding furniture is provided with a rotation system that allows for the rotation of the "user-contacting portion," i.e., a supporting frame and cushion/mattress components, between a storage position and a use position. Typically, the storage position is substantially upright (or vertical), and the furniture is housed in a decorative cabinet in this storage position. The use position is substantially horizontal, allowing the user to sit or lie on the cushion/or mattress held by the supporting frame. Because the combined weight of the elements that make up the user-contacting portion can be considerable, counterbalancing mechanisms are frequently employed that allow an individual to easily raise the user-contacting portion to the substantially upright storage position.

Various counterbalancing mechanisms have been developed for such folding furniture, including spring systems, counterbalancing hinges, and piston-based arrangements. Piston-based arrangements have proven to be especially effective in heavier applications, such as the counterbalancing of the weight of a wall bed, which includes the weight of the frame and the mattress (and possibly box springs). Examples of such piston-based arrangements are described in U.S. Pat. Nos. 5,033,134 and 5,978,988, each of which is incorporated herein by reference. As described in U.S. Pat. Nos. 5,033,134 and 5,978,988, two gas-filled counterbalance pistons, which provide an appropriate resistive force to the gravitational force acting on the frame and mattress, are respectively secured to the inside surfaces of the wall-mounted cabinet (housing the frame and mattress in the substantially upright storage position) and to the sides of the frame. The pistons are biased to resist, i.e., counterbalance, the downward force of gravity acting on the user-contacting portion, thus assisting in both the lowering of the user-contacting portion to the use position and the lifting/returning of the user-contacting portion to the substantially upright storage position.

Furthermore, and as also described in U.S. Pat. Nos. 5,033,134 and 5,978,988, such wall beds or other forms of folding furniture typically require some form of pivoting leg assembly that is pivoted into position to support the wall bed or other folding furniture in the use position. However, when returned to the substantially upright storage position, some portion of the pivoting leg assembly may still be visible, which can interfere with the appearance or use of the decorative cabinet in which article of folding furniture is housed.

SUMMARY OF THE INVENTION

The present invention is a pivoting leg assembly for an article of folding furniture, such as a wall bed.

An article of folding furniture, such as a wall bed, can be rotated between a substantially upright storage position and a substantially horizontal use position. For instance, an exemplary wall bed includes a frame that is pivotally attached to a cabinet and adapted to receive a user-contacting portion, such as a mattress. Two gas-filled counterbalance pistons are secured to the inside surfaces of the cabinet and to the side rails of the frame. The pistons are biased to resist the downward force of gravity acting on the user-contacting portion, thus assisting in both the lowering of the user-contacting portion and the frame to the use position and the lifting/returning of the user-contacting portion and the frame to the substantially upright storage position.

A pivoting leg assembly is operably connected to the frame and provides support for the frame when in the substantially horizontal use position. For instance, an exemplary pivoting leg assembly includes two legs. Each leg is pivotally connected to a respective leg support bar. Each such leg support bar is received in a respective sleeve that is secured to the frame of the wall bed, such that each leg support bar can move forward and rearward within its respective sleeve, in a plane substantially parallel to the frame. However, the movement of each such leg support bar relative to its respective sleeve is constrained in one direction by a cross member of the frame and in the other direction by a spring. When the wall bed is in the substantially upright storage position and housed within the cabinet, the leg extends away from the frame and toward the cabinet into a first position in which no portion of the leg is visible. When the wall bed is rotated out of the cabinet to the substantially horizontal use position, the leg is grasped and pivoted downward. As the leg is pivoted, the forces resulting from such pivoting will cause the leg support bar to move forward within the sleeve until the leg clears the lip of the frame, thus allowing the leg to continue pivoting to a second position in which it extends downward and away from the frame, and thus provides support to the frame in the use position.

As mentioned above, as the leg support bar moves, its movement is constrained. Specifically, the leg support bar is biased by the spring into the first position. In this regard, one end of a spring is attached by a screw to the cross member or other portion of the frame, while the opposite end of the spring is similarly attached to the leg support bar by a screw. Thus, the leg support bar will remain in this first position until the forces resulting from the pivoting of the leg cause the leg support bar to move forward within the sleeve against the biasing force of the spring. Of course, when the leg is pivoted from the second position to return it to the first position, the spring will assist in retracting the leg support bar.

The pivotal connection between the leg and the leg support bar is a pin connection, which is comprised of a threaded shaft that screws into a mating sleeve, passing through an end portion of the leg and a mating end portion of the leg support bar. Furthermore, the leg support bar defines a recess for receiving a spring-loaded ball. This spring-loaded ball engages one of a series of corresponding detents defined by the mating end portion of the leg. Thus, as the leg is pivoted relative to the leg support bar, it can be effectively fixed into any of the positions in which the spring-loaded ball engages one of the series of corresponding detents. Similarly, the second leg and second leg support bar operates in a like manner with respect to the leg and leg support bar described above.

DETAILED DESCRIPTION OF THE INVENTION

The present invention is a pivoting leg assembly for an article of folding furniture, such as a wall bed.

Figure 1B:
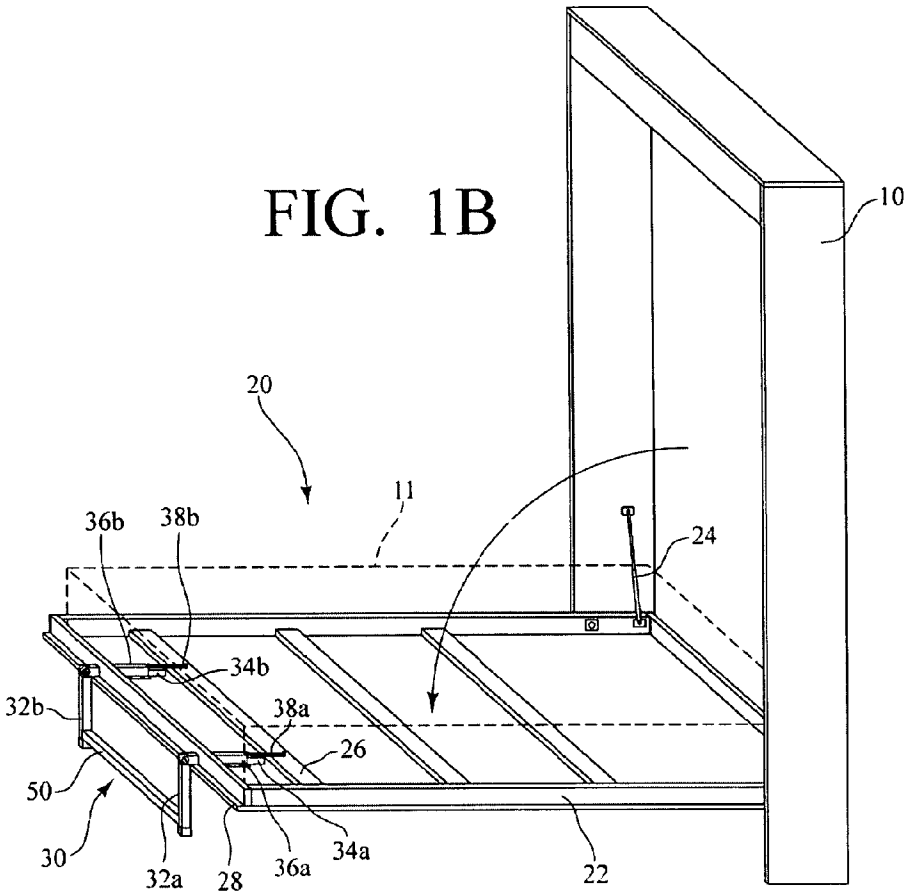
FIG. 1B is a perspective view of the exemplary article of folding furniture of FIG. 1A in a substantially horizontal use position.
Figure 1A:
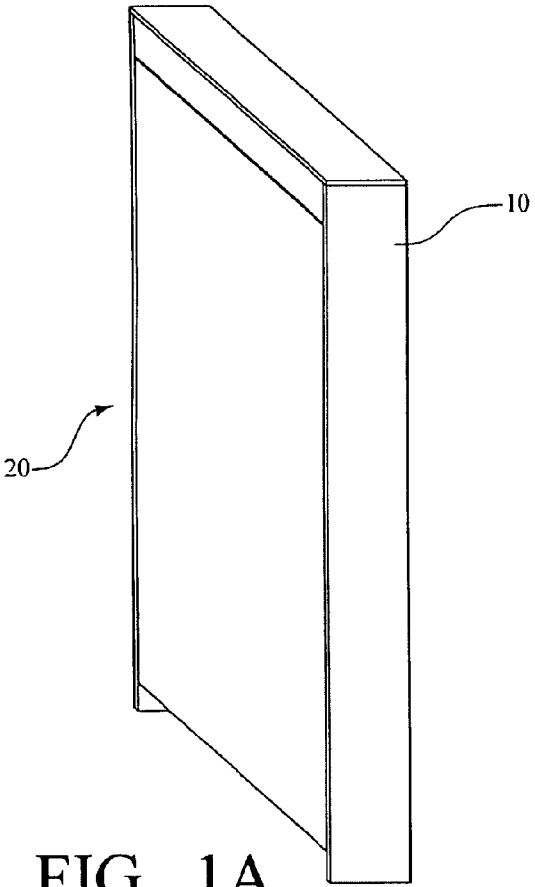
FIG. 1A is a perspective view of an exemplary article of folding furniture in a substantially upright storage position.

FIG. 1A illustrates an exemplary article of folding furniture, in this case, a wall bed 20, in a substantially upright storage position and housed within a cabinet 10. FIG. 1B illustrates the same wall bed 20, but in the substantially horizontal use position. As shown in FIGS. 1A and 1B, the wall bed includes a frame 22 that is pivotally attached to the cabinet 10 and adapted to receive a user-contacting portion 11, such as a mattress (shown in phantom in FIG. 1B). The user-contacting portion 11 is secured to the frame. Two gas-filled counterbalance pistons 24 (one of which is shown in FIG. 1B), which provide an appropriate resistive force to the gravitational force acting on the frame 22 (and user-contacting portion 11), are respectively secured to the inside surfaces of the cabinet 10 and to the side rails of the frame 22. As mentioned above with respect to U.S. Pat. Nos. 5,033,134 and 5,978,988, the pistons 24 are biased to resist, i.e., counterbalance, the downward force of gravity acting on the user-contacting portion 11, thus assisting in both the lowering of the user-contacting portion 11 and the frame 22 to the use position and the lifting/returning of the user-contacting portion 11 and the frame 22 to the substantially upright storage position.

Figure 2A:
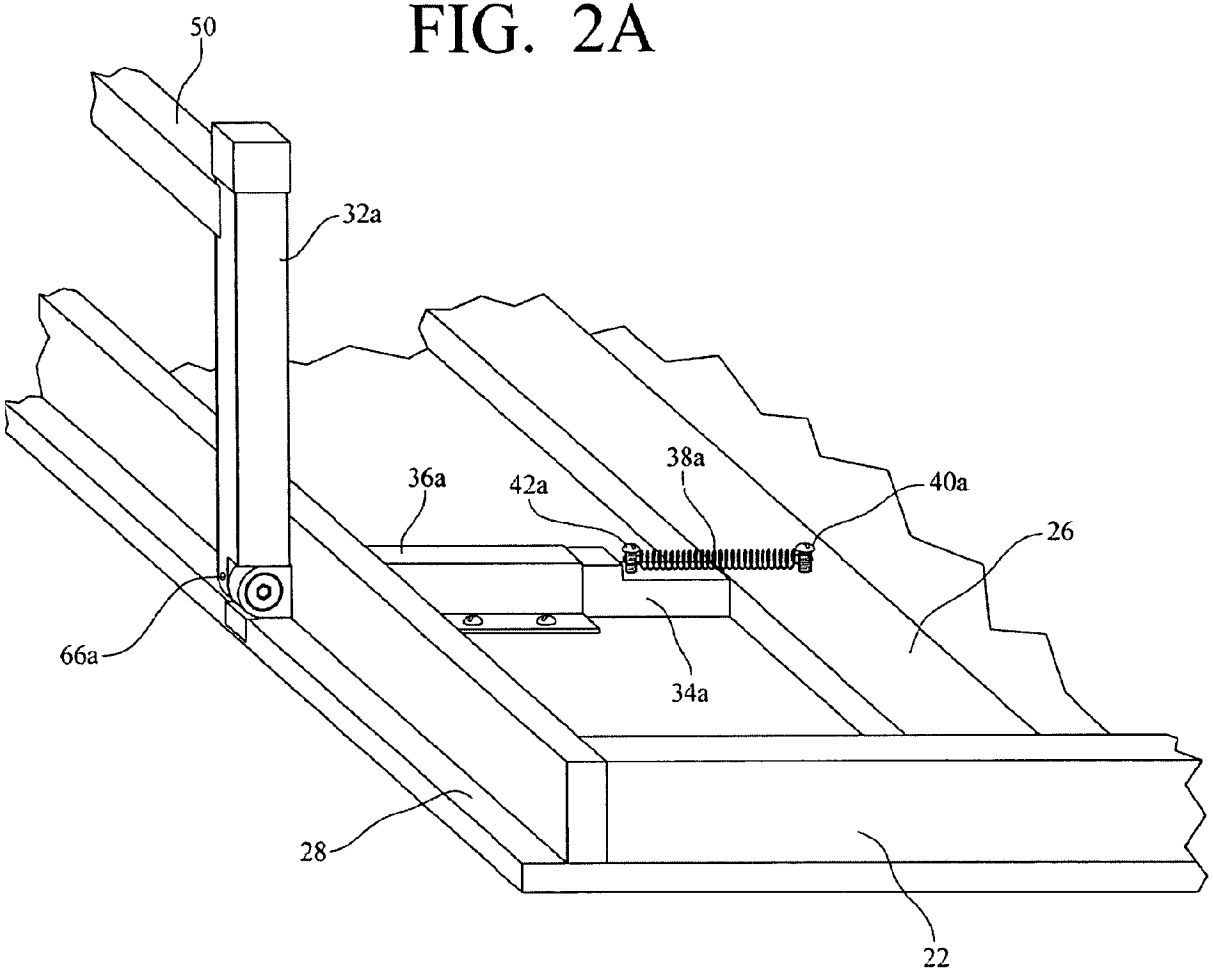
FIG. 2A is a perspective view of the exemplary article of folding furniture of FIGS. 1A and 1B, illustrating an exemplary pivoting leg assembly made in accordance with the present invention in a first position.
Figure 2B:
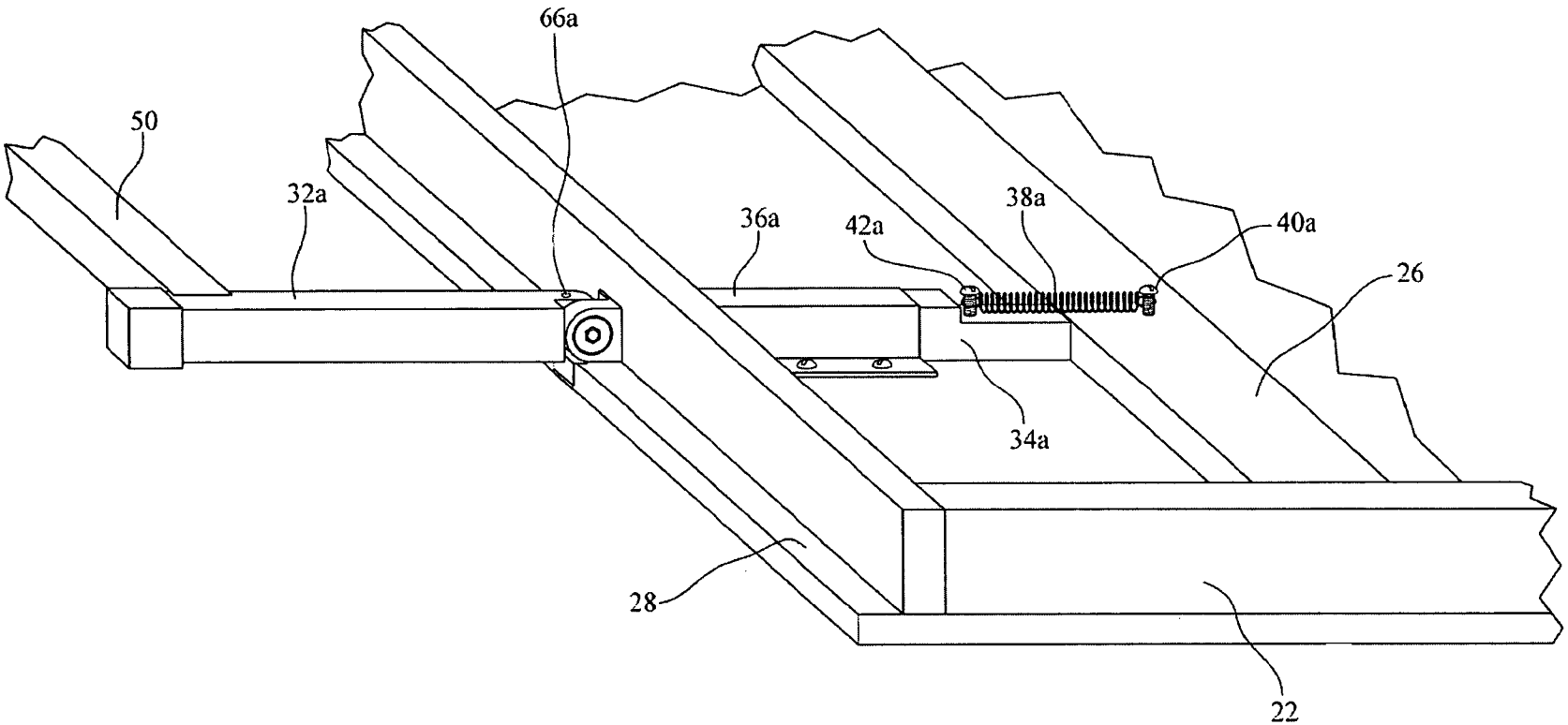
FIG. 2B is a perspective view of the exemplary article of folding furniture similar to FIG. 2A, but with the leg of the exemplary pivoting leg assembly aligned with the leg support bar.
Figure 2C:
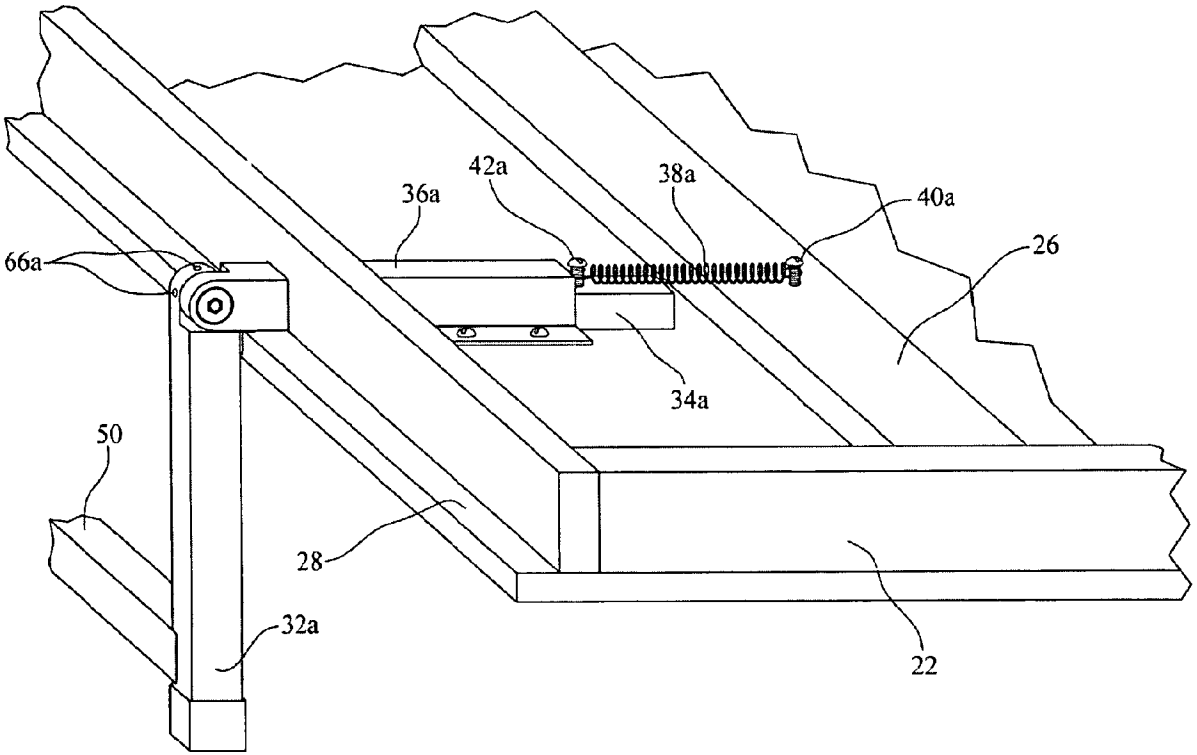
FIG. 2C is a perspective view of the exemplary article of folding furniture similar to FIG. 2A, but with the exemplary pivoting leg assembly in a second position.

Referring still to FIGS. 1A and 1B, along with the detailed views of FIGS. 2A, 2B, and 2C, in this exemplary embodiment, a pivoting leg assembly 30 is operably connected to the frame 22 and provides support for the frame 22 when in the substantially horizontal use position. In this exemplary embodiment, the pivoting leg assembly 30 includes two legs 32*a*, 32*b*. Each leg 32*a*, 32*b* is pivotally connected to a respective leg support bar 34*a*, 34*b*. Each leg support bar 34*a*, 34*b* is received in a respective sleeve 36*a*, 36*b* that is secured to the frame 22 of the wall bed 20, such that each leg support bar 34*a*, 34*b* can move forward and rearward within its respective sleeve 36*a*, 36*b*, in a plane substantially parallel to the frame 22 (i.e., substantially horizontal when in the use position). In other words, the leg support bars 34*a*, 34*b* are adapted for slidable movement with respect to the frame 22. However, the movement of each such leg support bar 34*a*, 34*b* relative to its respective sleeve 36*a*, 36*b* is constrained in one direction by a cross member 26 of the frame 22 and in the other direction by a spring 38*a*, 38*b* (or similar biasing means), as is further described below. Finally, in this exemplary embodiment, the two legs 32*a*, 32*b* are mechanically linked by a bar 50 extending between and connecting the legs 32*a*, 32*b*. Although this mechanical linkage ensures that the two legs 32*a*, 32*b* pivot together, it may be not necessary in all applications.

Referring now to the detailed views of FIGS. 2A, 2B, and 2C, the function and movement of one of the legs 32*a* is illustrated. First, with respect to FIG. 2A, when the wall bed 20 is in the substantially upright storage position and housed within the cabinet 10, the leg 32*a* extends away from the frame 22 and toward the cabinet 10 at an approximately 90-degree angle relative to the leg support bar 34*a* to which it is pivotally connected (i.e., a first position). In this regard, it should be noted that, in this exemplary embodiment, the lip 28 defined along the distal edge of the frame 22 has a width slightly greater than the width of the leg 32*a*. Accordingly, and referring again to FIG. 1A, when the wall bed 20 is in the substantially upright storage position and housed within the cabinet 10, no portion of the leg 32*a* is visible.

Referring now to FIGS. 2B and 2C, when the wall bed 20 is rotated out of the cabinet 10 to the substantially horizontal use position, the leg 32*a* is grasped and pivoted downward (i.e., counterclockwise in FIGS. 2B and 2C). In FIG. 2B, the leg 32*a* is aligned with the leg support bar 34*a* to which it is pivotally connected. As the leg 32*a* is pivoted past this position, the forces resulting from such pivoting will cause the leg support bar 34*a* to move forward within the sleeve 36*a* until the leg 32*a* clears the lip 28 of the frame 22, thus allowing the leg 32*a* to continue pivoting to the position illustrated in FIG. 2C, in which it extends downward and away from the frame 22 at an approximately 90-degree angle relative to the leg support bar 34*a* (i.e., a second position), and thus provides support to the frame 22 in the use position.

As the leg support bar 34*a* moves from the first position illustrated in FIG. 2A to the second position illustrated in FIG. 2C, and as mentioned above, its movement is constrained. Specifically, the leg support bar 34*a* is biased by the spring 38*a* into the position illustrated in FIG. 2A, where it abuts the cross member 26 of the frame 22. In this regard, one end of the spring 38*a* is attached by a screw 40*a* or similar fastener to the cross member 26, while the opposite end of the spring 38*a* is similarly attached to the leg support bar 34*a* by a screw 42*a* or similar fastener. Thus, the leg support bar 34*a* will remain in this position until the forces resulting from the pivoting of the leg 32*a* cause the leg support bar 34*a* to move forward within the sleeve 36 against the biasing force of the spring 38*a*. Of course, when the leg 32*a* is pivoted from the second position to return it to the first position as illustrated in FIG. 2A, the spring 38*a* will assist in retracting the leg support bar 34*a* into the first position abutting the cross member 26 of the frame 22.

Figure 3A:
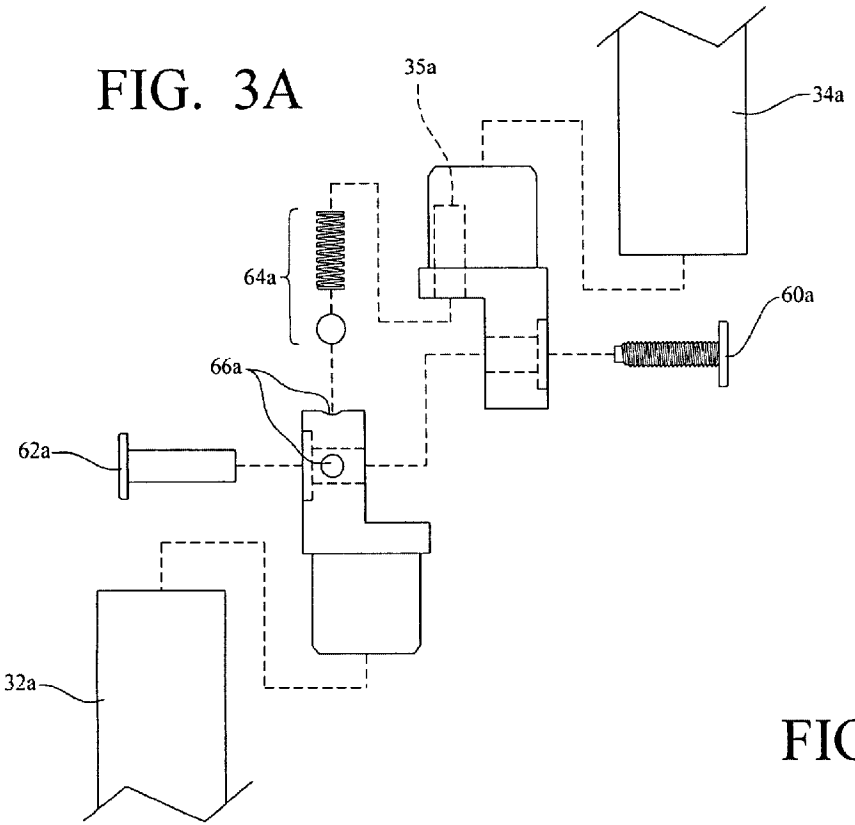
FIG. 3A is an exploded view of the connection between the leg and the leg support bar of the exemplary pivoting leg assembly of FIGS. 2A-2C.
Figure 3B:
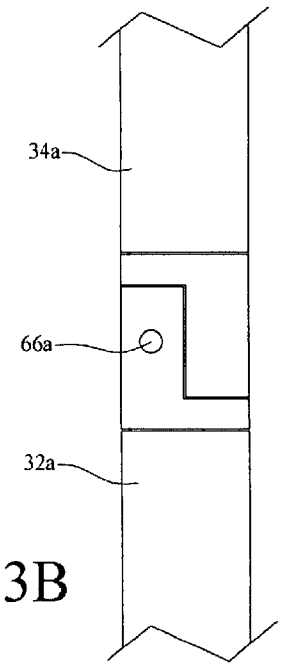
FIG. 3B is a top view of the connection between the leg and the leg support bar of the exemplary pivoting leg assembly of FIGS. 2A-2C.

FIGS. 3A and 3B are detailed views of the pivotal connection between the leg 32*a* and the leg support bar 34*a* in this exemplary embodiment. As shown, the pivotal connection is a pin connection, which is comprised of a threaded shaft 60*a* that screws into a mating sleeve 62*a*, passing through an end portion of the leg 32*a* and a mating end portion of the leg support bar 34*a*. Furthermore, in this exemplary embodiment, the leg support bar 34*a* defines a recess 35*a* for receiving a spring-loaded ball 64*a*. This spring-loaded ball 64*a* engages one of a series of corresponding detents 66*a* defined by the mating end portion of the leg 32*a*. Thus, as the leg 32*a* is pivoted relative to the leg support bar 34*a*, it can be effectively fixed into any of the positions in which the spring-loaded ball 64*a* engages one of the series of corresponding detents 66*a*.

Of course, the second leg 32*b* and second leg support bar 34*b* operate in the same as the leg 32*a* and leg support bar 34*a* described above. Furthermore, and as mentioned above, in this exemplary embodiment, the two legs 32*a*, 32*b* are mechanically linked by a bar 50 extending between and connecting the legs 32*a*, 32*b*. Although this mechanical linkage ensures that the two legs 32*a*, 32*b* pivot together, it may be not necessary in all applications.

One of ordinary skill in the art will recognize that additional embodiments are also possible without departing from the teachings of the present invention or the scope of the claims which follow. This detailed description, and particularly the specific details of the exemplary embodiment disclosed, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. An article of folding furniture, comprising:

a cabinet;

a frame operably connected to and housed within the cabinet for rotation between a substantially upright storage position and a use position;

a user-contacting portion secured to the frame; and a pivoting leg assembly operably connected to the frame, the pivoting leg assembly including a leg support bar adapted for slidable movement with respect to the frame, such that the leg support bar can move forward and rearward in a plane substantially parallel to the frame, and a leg pivotally connected to the leg support bar, such that it can be pivoted from a first position in which the leg extends upward and away from the frame in a substantially upright and perpendicular orientation relative to the frame to a second position in which the leg extends downward and away from the frame, thus providing support to the frame in the use position.

2. The article of folding furniture of claim 1, wherein said frame includes a lip defined along a distal edge of the frame, such that pivoting of the leg from the first position to the second position causes the leg support bar to move forward until the leg clears the lip, and wherein the lip defined along the distal edge of the frame has a width greater than a width of the leg, such that when the frame is in the storage position and the leg is in the first position, no portion of the leg is visible.

3. The article of folding furniture of claim 1, and further comprising a sleeve secured to the frame of the article of folding furniture, the sleeve receiving the leg support bar such that the leg support bar can move forward and rearward within the sleeve.

4. The article of folding furniture of claim 1, and further comprising a spring attached to and extending between a portion of the frame and the leg support bar, said spring biasing the leg support bar into the first position.

5. The article of folding furniture of claim 1, wherein the pivoting leg assembly further comprises a second leg support bar adapted for slidable movement with respect to the frame, such that the second leg support bar can move forward and rearward in a plane substantially parallel to the frame, and a second leg pivotally connected to the second leg support bar, such that it can be pivoted from a first position to a second position in which it extends downward and away from the frame, thus also providing support to the frame in the use position.

6. The article of folding furniture of claim 5, wherein the leg and the second leg are operably connected such that the leg and the second leg pivot together.

7. A folding bed, comprising:

a cabinet;

a frame operably connected to and housed within the cabinet in a substantially upright storage position;

a counterbalancing means secured to the cabinet and the frame for rotating the frame between the substantially upright storage position and a substantially horizontal use position;

a mattress secured to the frame; and a pivoting leg assembly operably connected to the frame, the pivoting leg assembly including a leg support bar adapted for slidable movement with respect to the frame, such that the leg support bar can move forward and rearward in a plane substantially parallel to the frame, and a leg pivotally connected to the leg support bar, such that it can be pivoted from a first position in which the leg extends away from the frame and toward the cabinet in a substantially upright and perpendicular orientation relative to the frame to a second position in which the leg extends downward and away from the frame, thus providing support to the frame in the substantially horizontal use position.

8. The folding bed of claim 7, wherein the counterbalancing means includes at least two pistons.

9. The folding bed of claim 7, wherein said frame includes a lip defined along a distal edge of the frame, such that pivoting of the leg from the first position to the second position causes the leg support bar to move forward until the leg clears the lip, and wherein the lip defined along the distal edge of the frame has a width greater than a width of the leg, such that when the frame is in the storage position and the leg is in the first position, no portion of the leg is visible.

10. The folding bed of claim 7, and further comprising a sleeve secured to the frame of the folding bed, the sleeve receiving the leg support bar such that the leg support bar can move forward and rearward within the sleeve.

11. The folding bed of claim 7, and further comprising a spring attached to and extending between a portion of the frame and the leg support bar, said spring biasing the leg support bar into the first position.

12. The folding bed of claim 7, wherein the pivoting leg assembly further comprises a second leg support bar adapted for slidable movement with respect to the frame, such that the second leg support bar can move forward and rearward in a plane substantially parallel to the frame; and a second leg pivotally connected to the second leg support bar, such that it can be pivoted from a first position in which it extends away from the frame and toward the cabinet to a second position in which it extends downward and away from the frame, thus also providing support to the frame in the substantially horizontal use position.

13. The folding bed of claim 12, wherein the leg and the second leg are operably connected such that the leg and the second leg pivot together.

* * * * *